US006347820B2

(12) United States Patent
Subliskey

(10) Patent No.: US 6,347,820 B2
(45) **Date of Patent: *Feb. 19, 2002**

(54) PICK RESISTANT SASH LOCK AND KEEPER AND METHOD OF LOCKING SASHES

(75) Inventor: Edward J. Subliskey, Mountain Twp, PA (US)

(73) Assignee: Allen Stevens Corp, Owatonna, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/636,284

(22) Filed: Aug. 10, 2000

Related U.S. Application Data

(63) Continuation of application No. 09/360,918, filed on Jul. 26, 1999, now Pat. No. 6,116,665, which is a continuation of application No. 08/906,923, filed on Aug. 6, 1997, now abandoned.

(51) Int. Cl.[7] ..... E05B 17/00

(52) U.S. Cl. ..... 292/346; 292/5; 292/DIG. 47; 292/241

(58) Field of Search ..... 292/4–7, 59, 63, 292/67, 128, 159, 140, 165, 169, 187, 240–242, DIG. 20, DIG. 35, DIG. 47, DIG. 45, 247, 346, DIG. 7, DIG. 62; 70/417

(56) References Cited

U.S. PATENT DOCUMENTS

| | | | | | |
|---|---|---|---|---|---|
| 1,029,274 | A | | 6/1912 | Caler | |
| 1,252,524 | A | * | 1/1918 | White | 70/90 |
| 1,275,938 | A | * | 8/1918 | Juselius | 292/346 |
| 1,896,509 | A | | 2/1933 | Carmichael | 292/169 |
| 1,899,466 | A | * | 2/1933 | Kistner | 292/346 |
| 2,489,078 | A | | 11/1949 | Cameron | 292/140 |
| 2,873,134 | A | * | 2/1959 | Ahlgren | 292/111 |
| 2,904,855 | A | | 9/1959 | Hagerty | 49/35 |
| 2,961,263 | A | * | 11/1960 | Ahlgren | 292/140 |
| 2,997,323 | A | * | 8/1961 | Riser | 292/111 |
| 3,261,629 | A | | 7/1966 | Campbell | 292/169 |
| 3,469,874 | A | | 9/1969 | Mercurio | |
| 4,790,583 | A | | 12/1988 | Tonsmania | |
| 5,090,570 | A | | 2/1992 | Lindquist | |
| 5,219,193 | A | | 6/1993 | Piltingsrud | |

* cited by examiner

*Primary Examiner*—Gary Estremsky
(74) *Attorney, Agent, or Firm*—Lorusso & Loud

(57) ABSTRACT

The sash lock has a rotatable cam which engages the keeper. The sash lock has a slide plate mounted below the cam and the slide plate moves between a retracted position in which its leading edge is flush with the sash to which the lock is mounted. In an extended position in which the leading edge of the plate extends far enough to block the narrow gap between the sashes. The slide plate is mounted for movement perpendicular to the edge of the sash and parallel to the plane of the top surface of the sash. The slide plate includes an arcuate recess in one side of the plate which is engaged by a pin extending from the rotatable cam. The recess in the slide plate is contoured so that during initial portion of the movement of the cam from its open position toward its locked position, the slide plate does not move. After the cam has moved far enough to engage the keeper, the slide plate moves outward toward the sash to which the keeper is mounted so as to block the gap between the two sashes in the region of the cam. It reduces the chances of a sash lock being forced open.

17 Claims, 4 Drawing Sheets

PICK RESISTANT SASH LOCK AND KEEPER AND METHOD OF LOCKING SASHES

RELATED APPLICATION DATA

This application is a continuation of U.S. patent application Ser. No. 09/360,918 filed Jul. 26, 1999 now U.S, Pat. No. 6,116,665, which is a continuation of U.S. patent application Ser. No. 08/906,923 filed Aug. 6, 1997, now abandoned.

FIELD OF THE INVENTION

The present invention relates to sash locks in general, and in particular to a sash lock which is resistant to being forced open, and so to a method of locking sashes.

BACKGROUND OF THE INVENTION

A common kind of sash lock cooperates with a keeper to tighten and lock a window. The keeper is mounted to one sash of a double-hung window. The sash lock has a rotatable cam mounted on a housing that is connected to the other sash of the window. Rotating the cam causes a finger which is part of the cam to move across the gap between the two sashes, engage a keeper mounted on the other sash and draw the sashes toward each other while forcing one sash up and the other down. This style of sash lock is common and quite old. It is also vulnerable to being forced open. In particular, it may be possible with some prior art sash locks to force a knife blade or similar tool into a crack between the two sashes, engage the cam with the blade, and force the lock to an open position.

SUMMARY OF THE INVENTION

It is an object of the present invention to reduce the chances of such a sash lock being forced open. To this end, the invention provides a sash lock with a rotatable cam to engage a keeper. The sash lock has a slide plate mounted below the cam. The slide plate is slidable between a retracted position in which its leading edge is withdrawn within the sash lock housing and substantially flush with the edge of the housing and an extended position in which the leading edge of the plate extends from the sash lock housing across the narrow gap between the sashes and into a slot in the keeper, so to prevent a knife blade from forcing the lock open. The slide plate is mounted for movement generally perpendicular to the edge of the sash, and it includes an arcuate recess in one side of the plate. The rotatable cam includes a pin which extends from the cam into the recess. When the cam is rotated, the finger moves, engaging the recess and forcing the slide plate to move outward into the gap between the sashes.

These and other features of the present invention will become clear from the following specification when taken together with the annexed drawings.

DESCRIPTION OF PREFERRED EMBODIMENT

Figure 1:
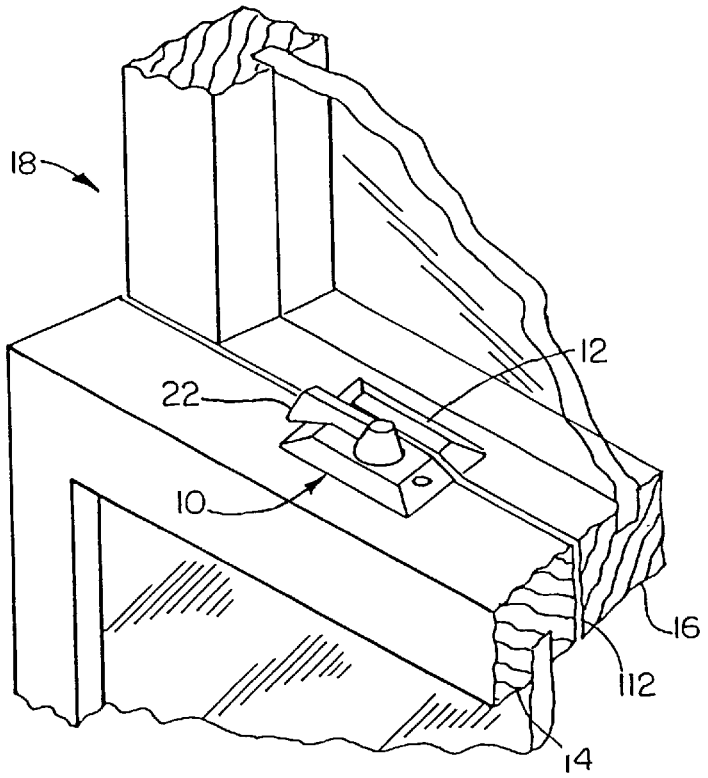
FIG. 1 is a perspective illustration, partially cut away, of a sash lock and keeper mounted on the lower and upper sashes, respectively, of a double hung window and constructed in accordance with the present invention.

FIG. 1 illustrates a sash lock 10 and keeper 12 mounted to the lower and upper sashes 14 and 16, respectively, of a double hung window assembly 18. The sash lock 10 includes a handle 22 which is rotatable about a vertical axis between a locked position (shown) and an unlocked position 180° away from the locked position. When the sash lock 10 and keeper 12 are aligned and the handle 22 is moved from the unlocked position to the locked position, the sash lock engages the keeper and prevents relative movement between the lower and upper sashes 14 and 16.

The sash lock 10 (FIG. 2) includes a housing 24, the handle 22, and a cam 26. The housing 24 includes a central cylindrical passage 28 through which a shaft 30 which is part of the handle 22 extends. The passage 28 is generally vertically oriented and forms a bearing to support the shaft 30 for rotation about a generally vertical axis (when the sash lock 10 is installed in a conventional application such as shown in FIG. 1).

Figure 4:
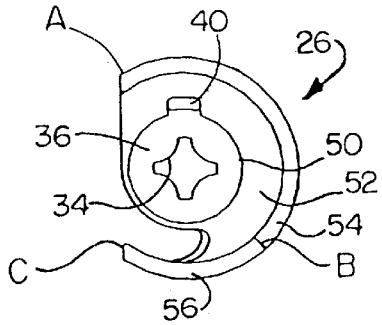
FIG. 4 is a top plan view of the cam shown in FIG. 2.

The shaft 30 includes a lower end portion 32 which is shaped like a four toothed pinion gear. The cam 26 includes a similarly shaped central opening 34 (FIG. 4). The lower end portion of the shaft 30 fits into the central opening 34 of the cam 26. During assembly, the lower end portion 32 of the shaft 30 is deformed or swaged into the central opening 34 of the cam 26 so that the cam 26 and handle 22 rotate together as an assembly about the vertical axis defined by the passage 28 through the housing 24.

The sash lock 10 includes a wave washer 35 which surrounds the shaft 30. The wave washer 35 extends between an annular surface 36 on the top of the cam 26 and an annular surface on the bottom of the housing 24. The wave washer 35 presses these surfaces away from each other and so eliminates vertical play while creating a controlled and constant amount of friction. In addition the handle 22 and the housing 24 may have conventional cooperating detents at the fully open and fully closed positions. The wave washer 35 biases the handle and housing into the detents to help retain the handle at its extreme positions.

Stop pin 40 (FIGS. 2 and 4) projects upward from the top of the cam 26. The housing 24 is provided with a pair of abutments 42 and 44. The stop pin 40 and abutments 42 and 44 are positioned so that the stop pin contacts the abutment 42 when the sash lock 10 is in the fully closed position, and the stop pin 40 contacts the abutment 44 when the sash lock is in the fully open position. The abutments 42 and 44 thus cooperate with the stop pin 40 to define the limits of rotation of the handle 22 about its vertical axis.

The cam 26 is formed with a central hub 50 through which the central opening 34 extends. A relatively thinner web 52 (FIGS. 2 and 4) connects the hub 50 with a peripheral rim 54. The rim 54 is generally rectangular in cross section and extends about 180° around the hub 50 from points A to points B in FIG. 4. At point B, the rim 54 blends into a ramp 56 which extends around approximately another 90° of the hub 50 from points B to points C. The top surface of the ramp 56 tapers upward to blend with the rim 54 between points C and B, while the bottom surface of the ramp 56 and rim 54 are coplanar. When the cam 26 is moved from its open position to its closed position, the leading end of the ramp 56 engages the keeper 12. As rotation continues, the ramp 56 lifts the keeper up and draws it toward the hub 50.

Figure 2:
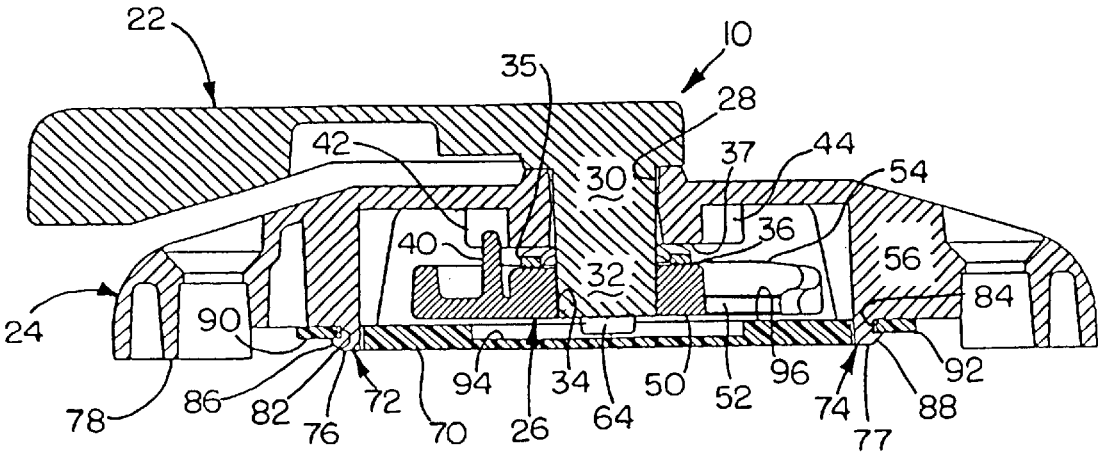
FIG. 2 is a cross sectional view of the sash lock shown in FIG. 1 and showing a handle, a housing, a cam, and a slide plate.
Figure 5:
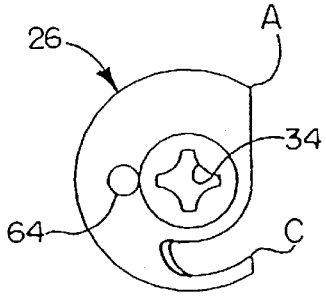
FIG. 5 is a bottom plan view of the cam shown in FIG. 2.

The cam 26 also includes a cylindrical pin 64 which extends downward from its bottom surface (FIGS. 2 and 5). The pin 64 is offset from the axis of shaft 30, and parallel to it. Accordingly, when the handle 22 rotates, the pin 64 moves in an arcuate path. The pin 64 is used to drive a slide plate 70 along a straight line path toward and away from the upper sash 16 as the handle 22 moves between its closed and open positions.

The housing 24 includes rails 72 and 74 which project downward. The rails 72 and 74 are in the form of rectangular solids which extend parallel to the path of the slide plate and perpendicular to the plane of the top surface 75 of the upper sash 16. The lower most surfaces 76 and 77 of the rails 72 and 74 respectively are spaced slightly above the bottom plane 78 of the housing 24 and 50 of the top surface 75 of the sash 14.

Figure 6:
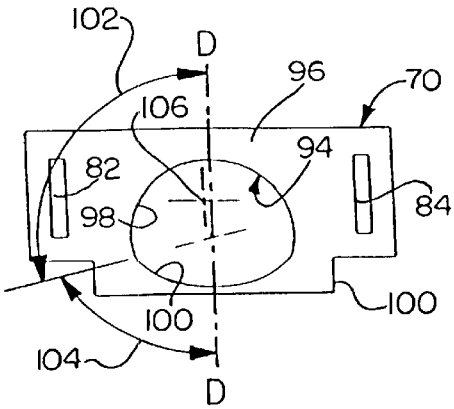
FIG. 6 is a top plan view of the slide plate shown in FIG. 2.
Figure 7:
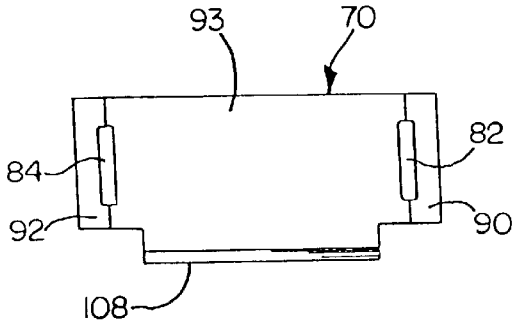
FIG. 7 is a bottom plan view of the slide plate shown in FIG. 2.

The slide plate 70 is provided with slots 82 and 84 (FIGS. 2, 6 and 7). The slots 82 and 84 have the same width as the rails 72 and 74 but are longer. The close fit between the long sides of the rails and the long sides of the slots assures slide plate 70 moves parallel to the rails 72 and 74.

The rails 72 and 74 each include a rib 86 which extends lengthwise along the rail. The housing 24, the rails 72 and 74 and the ribs 86 and 88 are die cast metal. The slide plate, on the other hand, is made of a hard plastic material which is slightly elastic. The slide plate 70 is installed on the housing 20 by pressing the slots 82 and 84 down over the ribs 86 and 88 and onto the rails 72 and 74. Once installed, the ribs 86 and 88 engage bottom surfaces 90 and 92 of the slide plate 70, retaining it in position and keeping it from moving vertically.

The slide plate 70 and rails 72 and 74 are shaped to provide a low profile when assembled so that the height of the sash lock 10 is not appreciably taller than a conventional sash lock. To this end, the bottom surfaces 90 and 92 are recessed upward from the major bottom surface 93 of the slide plate. The vertical offset between the bottom surfaces 90 and 92 and the major bottom surface 93 is equal to the vertical extent of the ribs 86 and 88. Therefore, when the slide plate 70 is installed, the lower most surfaces 76 and 77 of the rails 72 and 74 are flush with the major bottom surfaces of the slide plate 70.

The slide plate 70 has a recess 94 (FIGS. 2 and 6) formed in its top surface 96. The pin 64 which projects downward from the cam 26 is received in the recess 94. The pin 64 and recess 94 engage each other so that when the cam 26 rotates, the slide plate 70 undergoes reciprocating motion in the direction of the rails 72 and 74.

The recess 94 is contoured to control the motion of the slide plate 70. The recess 94 has a peripheral shape which is symmetrical about line D—D (a vertical centerline) shown in FIG. 6. This symmetry allows the slide plate 70 to be used for either left or right handed cams. Only the left side of the recess is described in detail, it being readily understood that the right side is similarly configured.

The perimeter of the left half of the recess 94 is divided into two segments, 98 and 100. The first of these, 98 extends from a 12:00 o'clock position to about an 8:00 o'clock position as viewed in FIG. 6. This angular extent is noted by the arrow 102. The segment 98 is centered about the axis of rotation of the shaft 30 when the slide plate is in its retracted position. The second perimeter segment, 100, extends from about the 8:00 o'clock position to a 6 o'clock position as shown by the arrow 104. This segment has a flatter curve (longer radius) and is centered about a point 106 which is above the center of segment 98 and slightly to the left of the centerline D—D.

Figure 8:
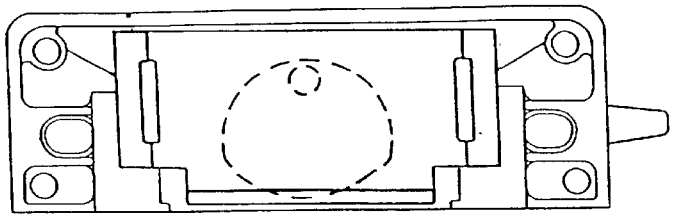
FIGS. 8 through 11 are bottom plan views of the sash lock shown in FIG. 1 and showing, progressively, movement from a fully open position (FIG. 8) to a fully closed position (FIG. 11)
Figure 9:
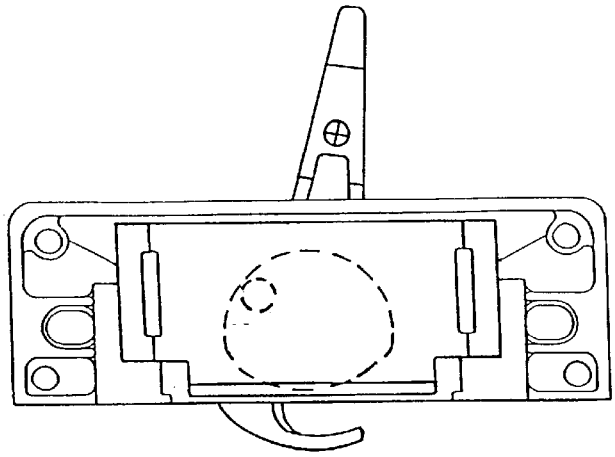

The interaction of the pin 64 on the cam 26 and the recess 94 on the slide plate 70 is illustrated in FIGS. 8 through 11. FIG. 8 shows the sash lock 10 in its fully open position. The pin 64 is resting at one end of the arcuate curve 96 of the recess 94. As the handle 22 is moved counterclockwise (as viewed in FIGS. 8 through 11), the pin 64 traces along the first curved segment 98 of the recess 94. One such intermediate position is illustrated in FIG. 9. The slide plate 70 does not move because the center of the curve 98 is coincident with the axis of rotation of the handle 22.

Figure 10:
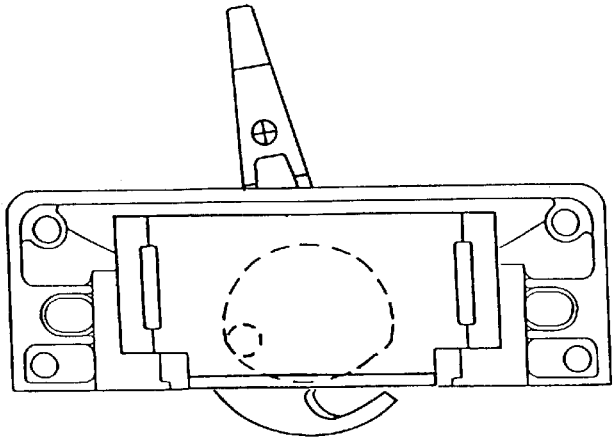
Figure 11:
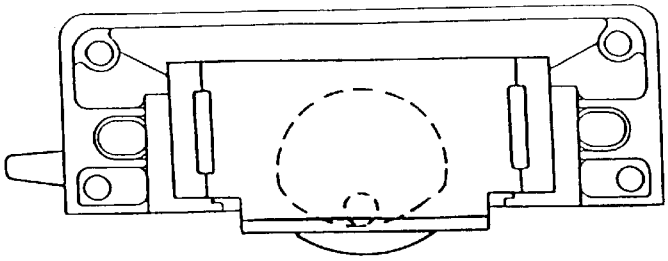
Figure 12:
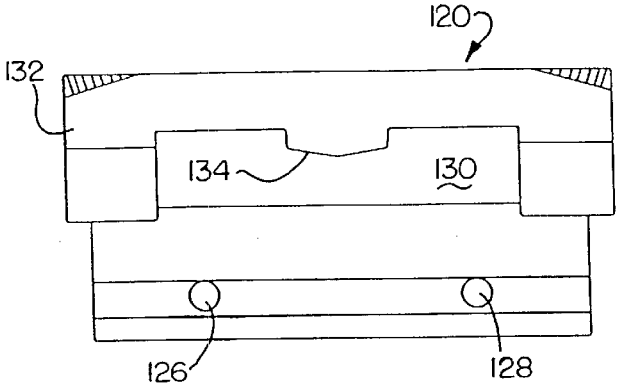
FIG. 12 is a front elevation view of a keeper for use with the sash lock of FIG. 1.
Figure 13:
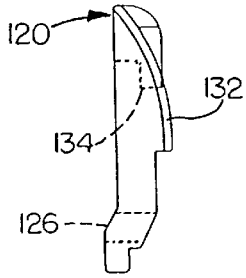
FIG. 13 is an end view of the keeper of FIG. 12.

After the handle 22 has rotated approximately 120° from its fully open position, the pin 64 reaches the end of the first segment 98 of the recess 94 as shown in FIG. 10. Continued rotation of the handle 22 from the position illustrated in FIG. 10 toward that illustrated in FIG. 11 causes the pin 64 to press against the curved segment 100 and to press the slide plate 70 outward to the position shown in FIG. 11.

When the handle 22 is moved from the locked position back toward the open position, the process is reversed. In the first about 60° of movement, the slide plate remains stationary. Then, the pin 64 engages the segment 98 and the slide plate 70 is driven into its retracted position as the pin presses against the wall segment 98 of the recess 94. As shown in the Figures, the retracted position of the slide plate 70 places the leading edge 108 of the slide plate flush with the edge 110 of the housing 24 which faces the opposing sash. However, it should be noted that this is a convenient feature it is not entirely necessary. All that is required of the retracted position is that the slide plate 70 be clear of the opposing sash so the sash can move even if part of the slide plate 70 extends outward from the housing. Such a retracted position is considered "retracted" as that term is used in this specification.

The locations of the pin 64 and recess 94 could be reversed. In such a case the pin would project upward into a slot or recess formed in the bottom of the cam. The recess in the bottom of the cam would be shaped to drive the slide plate with the desired motion. In either case there is a cam and follower relationship between two elements.

Figure 3:
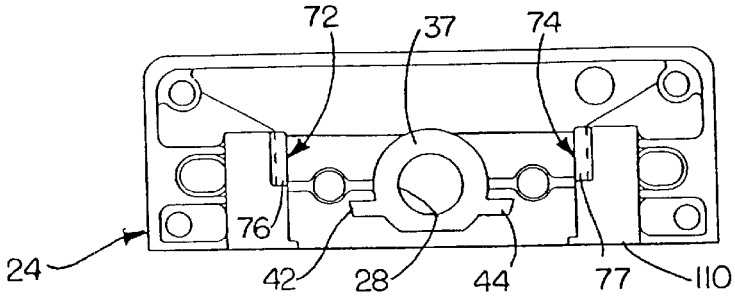
FIG. 3 is a bottom plan view of the housing shown in FIG. 2.

The total stroke of the slide plate 70 is just over 4/10 of an inch. The slide plate includes a leading edge 108 which projects outward past the edge 110 (FIG. 3) of the housing 24. The leading edge 108 which is curved upward on its leading edge, extends across the small space 112 (FIG. 1) in the lower and upper sashes 14 and 16, respectively and into a cavity 130 in the keeper 12 which is described more fully below. The leading edge 108 on the slide plate 70 reduces the chance that an intruder will be able to place a knife or other slender object into the space 112 to force the cam from its locked position to its open position and so to illicitly open the window.

Figure 14:
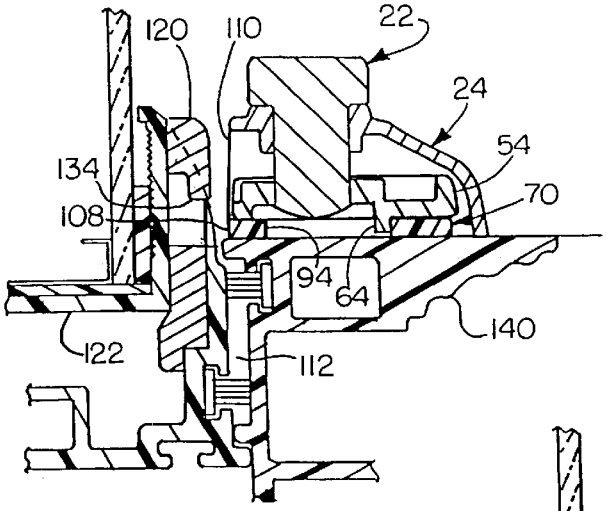
FIG. 14 is a cross section view showing a sash lock and keeper according to the present invention in the open position and mounted on a vinyl window sash.
Figure 15:
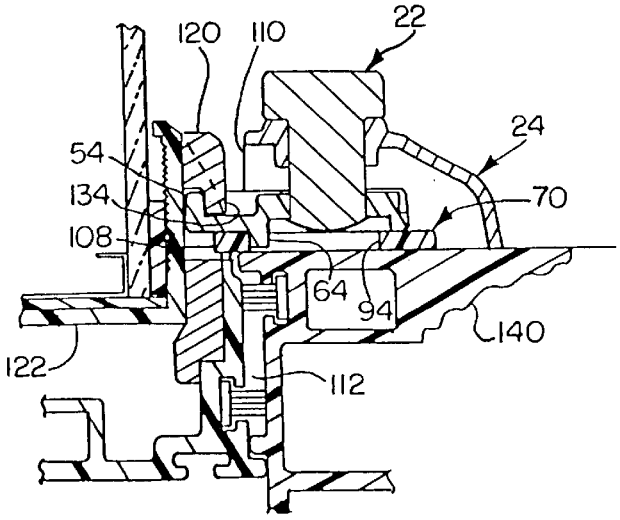
FIG. 15 is a cross section view showing a sash lock and keeper according to the present invention in the closed position and mounted on a vinyl window sash.

One keeper 120 which is configured to receive the slide plate 70 is shown in FIGS. 12 through 15. The keeper 120 shown in FIGS. 12 and 13 has a profile that matches the profile of the upper sash 122 sash to which it may be mounted. See FIGS. 14 and 15. By making an appropriately shaped recess in the upper sash the keeper 120 may be set into the surface of the sash 122 and be made generally flush with it. When used with an extruded vinyl sash 122, as shown in FIGS. 14 and 15, a part of the keeper is inside the sash. In that case the keeper 120 may be held in place by screws (not shown) that pass through the sash and into openings 126 and 128 (FIG. 12) formed in the keeper.

The keeper 120 has an opening 130 in its front face 132. The opening 130 is generally rectangular when viewed from the front (FIG. 12), and it includes an engagement tooth 134 which extends downward from the top of the opening. The engagement tooth 134 is positioned so that the ramp 56 (FIGS. 2 and 4) of the cam 26 can reach behind it and force the keeper 120—and the upper sash 122—upward as the cam rotates.

The opening 130 is tall enough so that the cam 24 and the slide plate 70 can pass inside the keeper 120. FIGS. 14 and 15 show the keeper 120 and the sash lock 10 in cross section and mounted to exemplary upper and lower sashes 122 and 140, respectively. When in the open position (FIG. 14) the slide plate 70 is entirely within the housing 24, and the sashes 122 and 140 are free to move relative to each other to open the window. When the sash lock is the closed position (FIG. 15), the slide plate 70 extends across the gap 112 between the upper and lower sashes 122 and 140, driven to that position by the pin 64 which projects down from the cam 26. The pin 64 engages the curved wall of the recess 94 and pushes the slide plate out 70 to the position shown in FIG. 15. The slide plate 70 spans the gap 112 and so prevents a knife or other blade from being used to force the sash lock 10 to an open position.

Thus it is clear that the present invention provides a sash lock 10 that is resistant to being forced open. The sash lock 10 has a slide plate 70 (FIG. 2) mounted below the cam 26 and slidable between a retracted position (FIGS. 8 and 14) in which a leading edge is flush with the sash 14 (FIG. 1) or 140 (FIG. 14) to which the lock is secured and an extended position (FIGS. 11 and 15) in which the leading edge of the plate extends from the sash far enough to block the narrow gap 112 (FIGS. 1 and 15) between the sashes and so to prevent a knife from forcing the lock open. The slide plate 70 (FIG. 2) is mounted for movement perpendicular to the edge of the sash, and it includes an arcuate recess 94 in one side of the plate. The rotatable cam 26 includes a pin 64 which extends from the cam into the recess 94. When the cam 26 is rotated, the pin 64 moves, engaging the recess 94 and forcing the slide plate 70 to move outward into the gap 114 between the sashes.

What is claimed is:

1. A sash lock having a housing, a rotating assembly mounted in the housing, the rotating assembly including a handle rotatable in the housing and moveable between open and closed positions, a shaft connected to the handle and rotatable with the handle, a cam connected to the shaft, and contoured to engage a keeper, a slide plate mounted to the housing and slidable between a retracted position in which it is within the housing and an extended position in which it projects from the housing, a pin extending from one of the rotating assembly and the slide plate and a recess formed in the other of the rotating assembly and the slide plate, the pin and recess cooperating to drive the slide plate between its retracted and extended positions as the handle moves between its open and closed positions, the rotating assembly turning approximately 180° between the open and closed positions, and the recess being symmetric about a line which is parallel to the direction of movement of the slide plate.

2. A sash lock having a housing, a rotating assembly mounted in the housing, the rotating assembly including a handle rotatable in the housing and moveable between open and closed positions, a shaft connected to the handle and rotatable with the handle, a cam connected to the shaft, and contoured to engage a keeper, a slide plate mounted to the housing and slidable between a retracted position in which it is within the housing and an extended position in which it projects from the housing, a pin extending from one of the rotating assembly and the slide plate and a recess formed in the other of the rotating assembly and the slide plate, the pin and recess cooperating to drive the slide plate between its retracted and extended positions as the handle moves between its open and closed positions, the pin being connected to the rotating assembly and the recess being formed in the slide plate, the pin being part of the cam and the recess being formed in the slide plate, the recess being symmetric about a line parallel to the direction of movement of the slide plate.

3. The sash lock of claim 2 in which the recess in the slide plate has a peripheral shape that cooperates with the pin to cause the slide plate to be stationary during one part of the rotation of the handle between its open and closed positions and to move between its retracted and extended positions during another part of the rotation of the handle.

4. The sash lock of claim 3 wherein the housing is formed of metal and the slide plate is formed of plastic.

5. The sash lock of claim 4 in which the housing includes axially extending rails which extend parallel to the direction of movement of the slide plate and the slide plate includes slots for receiving the rails, the rails guiding the slide plate for straight line movement generally parallel to the axis of the rails.

6. The sash lock of claim 5 in which the rails include ribs which engage the slide plate to retain the slide plate in a plane parallel to the axes of the rails.

7. The sash lock of claim 6 in which the slots in the slide plate each have a closed boundary.

8. The sash lock of claim 6 in which the rails have bottom surfaces and the slide plate has a major surface which is flush with the bottom surfaces of the rails.

9. A sash lock having a housing, a rotating assembly mounted in the housing, the rotating assembly including a handle rotatable in the housing and moveable between open and closed positions, a shaft connected to the handle and rotatable with the handle, a cam connected to the shaft, and contoured to engage a keeper, a slide plate mounted to the housing and slidable between a retracted position in which it is within the housing and an extended position in which it projects from the housing, a pin extending from one of the rotating assembly and the slide plate and a recess formed in the other of the rotating assembly and the slide plate, the recess cooperating to drive the slide plate between its retracted and extended positions as the handle moves between its open and closed positions, the rotating assembly turning approximately 180° between the open and closed positions, and the recess being symmetric about a line which is parallel to the direction of movement of the slide plate, the housing includes axially extending rails which extend parallel to the direction of movement of the slide plate and the slide plate includes slots for receiving the rails, the rails guiding the slide plate for straight line movement generally parallel to the axis of the rails.

10. The sash lock of claim 9 in which the rails include ribs which engage the slide plate to retain the slide plate in a plane parallel to the axis of the rails.

11. The sash lock of claim 10 in which the slots in the slide plate have a closed boundary.

12. The sash lock of claim 10 in which a portion of the keeper is mounted within a sash.

13. The sash lock of claim 12 wherein the sash is extruded vinyl.

14. The sash lock of claim 9 wherein the slide plate includes a leading edge which is curved upward.

15. The sash lock of claim 14 in which the leading edge is flush with the sash to which the lock is secured and an extended position in which the leading edge of the plate extends from the sash far enough to block the narrow gap between the sashes and so to prevent a knife from forcing the lock open.

16. The sash lock of claim 9 in which a wave washer surrounds the shaft and extends between an annular surface on the top of the cam and an annular surface on the bottom of the housing wherein the wave washer presses these surfaces and eliminates vertical play while creating a controlled amount of friction.

17. The sash lock of claim 16 in which the handle and housing have cooperating detents at the fully open and closed positions wherein the wave washer biases the handle and housing into the detents to retain the handle a its extreme positions.

* * * * *